US011885060B2

(12) United States Patent
Kim et al.

(10) Patent No.: US 11,885,060 B2
(45) Date of Patent: Jan. 30, 2024

(54) LAUNDRY DEVICE

(71) Applicant: LG Electronics Inc., Seoul (KR)

(72) Inventors: Sungmin Kim, Seoul (KR); Hyoungmin Sim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/769,184

(22) PCT Filed: Dec. 16, 2020

(86) PCT No.: PCT/KR2020/018411

§ 371 (c)(1),
(2) Date: Apr. 14, 2022

(87) PCT Pub. No.: WO2021/125773

PCT Pub. Date: Jun. 24, 2021

(65) Prior Publication Data

US 2023/0030540 A1 Feb. 2, 2023

(30) Foreign Application Priority Data

Dec. 16, 2019 (KR) ..... 10-2019-0167511

(51) Int. Cl.
*D06F 37/42* (2006.01)
*D06F 33/48* (2020.01)
(Continued)

(52) U.S. Cl.
CPC ..... *D06F 37/42* (2013.01); *D06F 23/06* (2013.01); *D06F 33/48* (2020.02); *D06F 34/20* (2020.02);
(Continued)

(58) Field of Classification Search
CPC ..... D06F 37/22; D06F 37/28; D06F 37/42; D06F 33/48; D06F 23/06; D06F 34/20;
(Continued)

(56) References Cited

U.S. PATENT DOCUMENTS

2011/0120195 A1* 5/2011 Jeoung ..... D06F 37/28 68/139
2018/0073180 A1 3/2018 Jo et al.

FOREIGN PATENT DOCUMENTS

CN 1659324 8/2005
CN 101660257 3/2010
(Continued)

OTHER PUBLICATIONS

KR20110028899A—machine translation (Year: 2011).*
(Continued)

*Primary Examiner* — Tinsae B Ayalew
(74) *Attorney, Agent, or Firm* — Fish & Richardson P.C.

(57) ABSTRACT

The present disclosure relates to a laundry device provided with: a cabinet which includes a front cabinet having a cabinet input hole formed therein; a tub which is installed inside the cabinet and has a tub input hole positioned on an extension line of the cabinet input hole; a cabinet door which is installed in the cabinet and opens and closes the cabinet input hole; a tub door which is installed in the tub and opens and closes the tub input hole; a cabinet door lock which senses whether the cabinet door is open or closed, as well as sets the lock state of the cabinet door; and a tub door lock which sets the lock state of the tub door according to whether the cabinet door is open or closed.

13 Claims, 11 Drawing Sheets

(51) Int. Cl.

| | |
|---|---|
| ***D06F 34/20*** | (2020.01) |
| ***D06F 23/06*** | (2006.01) |
| ***D06F 37/22*** | (2006.01) |
| ***D06F 37/28*** | (2006.01) |
| ***D06F 39/14*** | (2006.01) |
| *D06F 105/44* | (2020.01) |
| *D06F 103/40* | (2020.01) |

(52) U.S. Cl.
CPC ..... *D06F 37/22* (2013.01); *D06F 37/28* (2013.01); *D06F 39/14* (2013.01); *D06F 2103/40* (2020.02); *D06F 2105/44* (2020.02)

(58) Field of Classification Search
CPC ... D06F 39/14; D06F 2103/40; D06F 2105/44
USPC ..... 68/12.26
See application file for complete search history.

(56) References Cited

FOREIGN PATENT DOCUMENTS

| | | |
|---|---|---|
| CN | 102071556 | 5/2011 |
| CN | 107447432 | 12/2017 |
| CN | 107923099 | 4/2018 |
| CN | 109082857 | 12/2018 |
| EP | 2141277 | 1/2010 |
| EP | 2327824 | 6/2011 |
| JP | H04-187187 | 7/1992 |
| KR | 20110028899 | 3/2011 |
| KR | 20110057920 | 6/2011 |
| KR | 101231027 | 2/2013 |
| KR | 20160112648 | 9/2016 |
| RU | 2506361 | 2/2014 |

OTHER PUBLICATIONS

International Search Report and Written Opinion in International Appln. No. PCT/KR2020/018411, dated Mar. 11, 2021, 13 pages (with English translation).
Office Action in Russian Appln. No. 2022109173, dated Dec. 16, 2022, 10 pages (with English translation).
Office Action in Chinese Appln. No. 202080080183.6, dated Mar. 18, 2023, 17 pages (with English translation).

* cited by examiner

LAUNDRY DEVICE

CROSS-REFERENCE TO RELATED APPLICATIONS

This application is a National Stage application under 35 U.S.C. § 371 of International Application No. PCT/KR2020/018411, filed on Dec. 16, 2020, which claims the benefit of Korean Application No. 10-2019-0167511, filed on Dec. 16, 2019. The disclosures of the prior applications are incorporated by reference in their entirety.

TECHNICAL FIELD

The present disclosure relates to a washing machine, and more particularly to a washing machine which is improved in a door-opening-and-closing structure in order to facilitate opening and closing of a cabinet door and a tub door and to prevent vibration and noise, which are generated by a tub while the washing machine is operated, from being transmitted to a case of the washing machine.

BACKGROUND ART

Generally, a washing machine is a product configured to eliminate various contaminants from clothes or bedclothes using emulsification of detergent, abrasive action caused by the flow of water generated by rotation of a pulsator or a drum, and impact action applied to the laundry. Full automatic washing machines, which have been developed recently, are designed to automatically perform a series of procedures including a washing course, a rinsing course, a spin-drying course and the like without intervention or manipulation by a user.

The recent trend is toward increasing demand for a drum-type washing machine, which is reduced in overall height and almost completely avoids a problem in which laundry in entangled and a large amount of wrinkles are formed in laundry, compared to a pulsator-type washing machine in which a washing tub is rotated in an erect state.

Briefly explaining the general structure of a washing machine, the general washing machine includes a body cabinet defining the appearance of the washing machine, a tub positioned in the body cabinet so as to store washing water therein and supported by a damper and a spring, a cylindrical drum positioned in the tub and configured to receive laundry therein, and a drive unit configured to rotate the drum.

Such a general washing machine necessarily includes a gasket between the opening in the tub and the body cabinet in order to prevent leakage of washing water stored in the tub.

The above-mentioned general washing machine necessarily causes vibration due to the rotational force of the drum, eccentric disposition of laundry or the like while the drum is rotated in order to perform washing and spin-drying procedures for laundry introduced into the drum, and the vibration generated due to rotation of the drum may be transmitted to the cabinet via the tub.

Here, the vibration and noise transmitted to the tub may be transmitted to the cabinet via the gasket configured to ensure a water seal between the cabinet and the tub, thereby causing the cabinet to vibrate and emit noise.

In order to solve the above-mentioned problems with the general washing machine, a "drum-type washing machine" of Korean Unexamined Patent publication No. 10-2011-0057920 (hereinafter, referred to as "Patent Document 1") has been proposed.

Patent Document 1 is designed to omit a gasket, which is considered to be the cause of transmission of vibration in a general washing machine, and to provide a cabinet and a tub with a first door (a cabinet door) and a second door (a tub door), respectively, in order to prevent transmission of vibration via a gasket.

In the case of Patent Document 1, the first door and the second door must be respectively locked to the cabinet and the tub so as to open and close the cabinet and the tub, and the first door and the second door must be separately maintained in the locked state during operation of the washing machine.

As described above, because a washing machine according to a conventional technology includes a first door and a second door, which are separately constructed, there is need for a novel structure capable of setting locked states of the first door and the second door.

DISCLOSURE

Technical Task

An object of the present disclosure is to provide a washing machine, which has an improved structure between a tub and a cabinet so as to prevent vibration and noise of the tub from being transmitted to the cabinet.

Another object of the present disclosure is to provide a washing machine, which is improved with regard to an interior structure between a cabinet and a tub so as to increase the capacity of the tub compared to a conventional structure.

Still another object of the present disclosure is to provide a washing machine in which a locking/releasing structure of a cabinet door is improved so as to facilitate opening and closing of the cabinet door and a tub door.

Yet another object of the present disclosure is to provide a washing machine capable of closing a tub door in response to closing of a cabinet door.

Still yet another object of the present disclosure is to provide a washing machine capable of setting locking of a tub door in response to closing of a cabinet door.

The objects of the present disclosure are not limited to the above-mentioned objects, and other objects of the present disclosure, which are not mentioned above, will be clearly understood by those skilled in the art from the following descriptions.

Technical Solutions

In order to accomplish the above objects, a washing machine according to an embodiment of the present disclosure includes a cabinet including a front cabinet in which a cabinet introduction port is formed, a tub disposed in the cabinet and having a tub introduction port coaxially positioned with the cabinet introduction port, a cabinet door mounted on the cabinet so as to open and close the cabinet introduction port, a tub door mounted on the tub so as to open and close the tub introduction port, a cabinet door lock configured to set a locked state of the cabinet door and to detect whether the cabinet is open or closed, and a tub door lock configured to set the locked state of the tub door depending on whether the cabinet door is open or closed.

The washing machine may further include a tub door lock releaser configured to actuate the tub door lock depending on whether the cabinet door is open or closed.

The cabinet door lock may include a detector configured to detect whether the cabinet is open or closed and to transmit a result of detection.

The tub door lock releaser may include a solenoid configured to be activated in response to a signal of the detector, a rotating portion configured to be moved in response to activation of the solenoid, and a tensile cable connected to the rotating portion.

The tub door lock and the tub door lock releaser may be connected to each other via the tensile cable.

The tub door may include an engaging hook, and the tub door lock may be inserted into the engaging hook so as to push the door toward the tub introduction port.

The tub door lock may include a body provided at the tub and a rotating hook rotatably provided at the body and inserted into the engaging hook.

The rotating hook may be elastically supported so as to be rotated in a direction in which a locked state of the tub door is released, and may be rotated by means of the tensile cable in a direction in which the tub door is locked.

The rotating hook may include a hook protrusion having a radius which decreases moving toward a rotational center of the rotating hook.

The engaging hook may have an engaging hole, and the hook protrusion may be inserted into the engaging hole when the rotating hook is rotated.

The cabinet door may include a hook configured to be inserted into the cabinet door lock, and the detector may detect insertion and removal of the hook.

The cabinet door may include an inner frame including the hook and defining an inner surface of the cabinet door abutting the cabinet introduction port, and an outer frame coupled to the inner frame so as to define an outer surface of the cabinet door and including a handle having a release lever configured to rotate the hook.

The tub door may include a tub inner frame defining an inner surface of the tub door abutting the tub introduction port and including an engaging hook engaged with the tub door lock, and a tub outer frame coupled to the tub inner frame so as to define an outer surface of the tub door.

One of the inner frame and the tub outer frame may include a magnet configured to generate magnetic force, and a remaining one of the inner frame and the tub outer frame includes a metal plate.

Advantageous Effects

The washing machine according to the present disclosure offers an effect in that, since the structure between the tub and the cabinet is improved so as to prevent vibration and noise generated in the tub from being transmitted to the cabinet, it is possible to reduce vibration and noise generated by the cabinet and to prevent the unpleasant vibration and noise from being transmitted to a user.

Furthermore, the washing machine according to the present disclosure offers an effect of increasing the capacity of the tub due to improvement in the structure between the tub and the cabinet.

In addition, the washing machine according to the present disclosure offers an effect of facilitating opening and closing of the cabinet door and the tub door due to an improvement in the locking/releasing structure of the cabinet door.

Furthermore, the washing machine according to the present disclosure offers an effect of allowing the tub door to be closed in response to closing of the cabinet door.

In addition, the washing machine according to the present disclosure offers an effect of setting locking of the tub door in response to closing of the cabinet door.

The effects of the present disclosure are not limited to the above-mentioned effects, and other effects of the present disclosure, which are not mentioned above, will be clearly understood by those skilled in the art from the attached claims.

BEST MODE FOR DISCLOSURE

Figure 1:
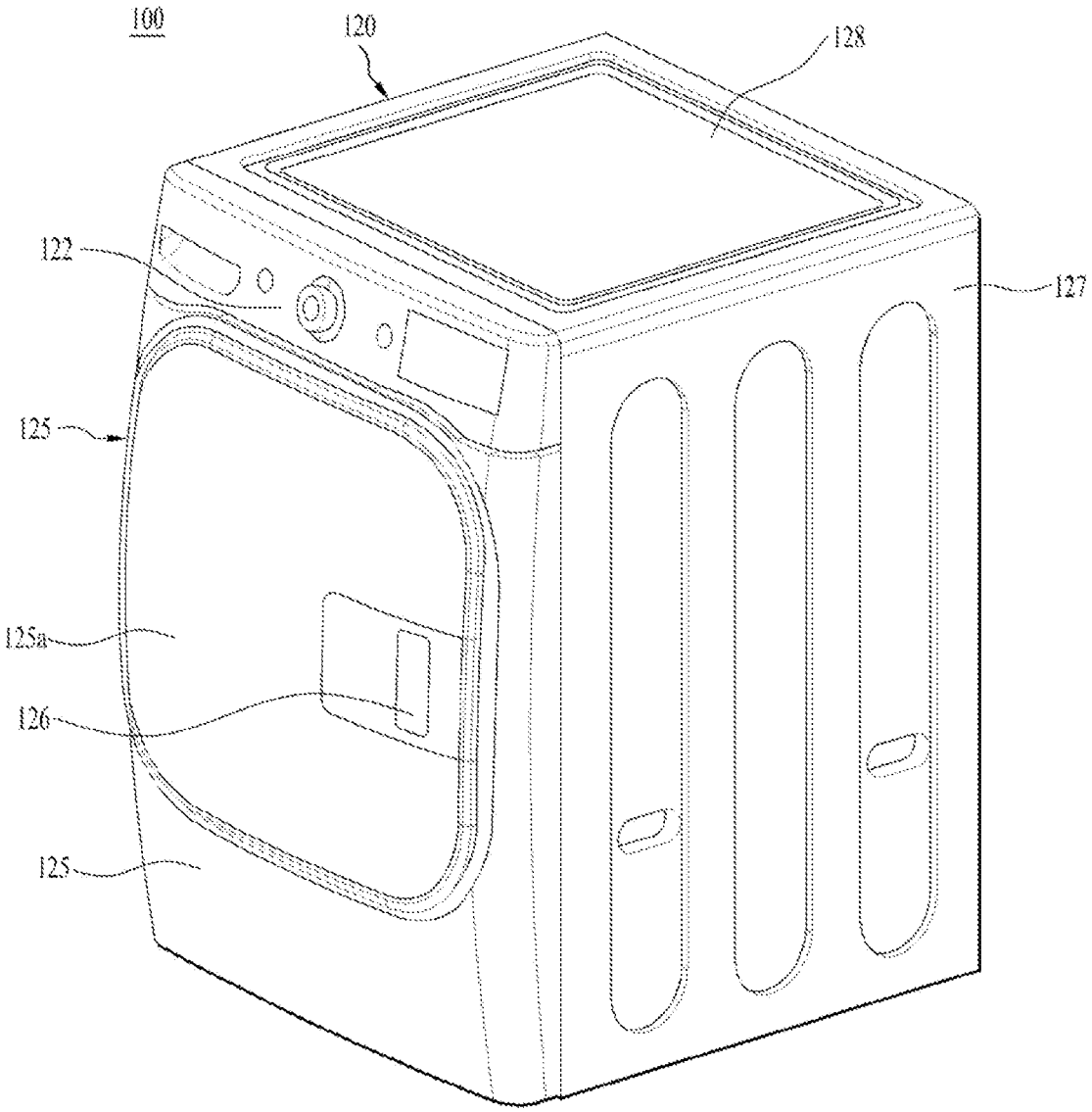
FIG. 1 is a perspective view illustrating the washing machine according to an embodiment of the present disclosure.

Hereinafter, a washing machine according to the present disclosure will be described in detail.

In the description of the present disclosure, the names of components disclosed in the present closure are defined in consideration of functions in the present disclosure. Accordingly, the names of the components should not be construed as limiting the components. Furthermore, the components defined by the names may be referred to using other names in a relevant technical field.

Regardless of reference numerals, the same or similar elements are denoted by the same reference numerals irrespective of their reference numerals, and a redundant description thereof is omitted. For clarity of description, the shapes and sizes of components in the drawings may be exaggerated or scaled down.

It will be understood that although the terms "first", "second", etc. may be used herein to describe various elements, these elements should not be construed as being limited by these terms. These terms are only used to distinguish one element from another.

In this specification, it should be understood that, when an element is referred to as being "connected with" another element, there may be intervening elements present, or the element may be directly connected with the another element.

In contrast, it should be understood that, when an element is referred to as being "directly connected with" another element, there are no intervening elements present.

In this specification, terms such as "includes" or "has" used herein should be considered as indicating the presence of various features, numbers, steps, operations, elements, components or combinations thereof disclosed in the specification, but it should be understood that the presence or addition of one or more other features, numbers, steps, operations, elements, components or combinations thereof is not excluded.

In this specification, the term "and/or" includes a combination of a plurality of listed items or any of a plurality of listed items. In this specification, "A or B" may include "A", "B" or "both A and B".

First, the washing machine of an embodiment of the present disclosure will be briefly described with reference to the accompanying drawings.

Figure 2:
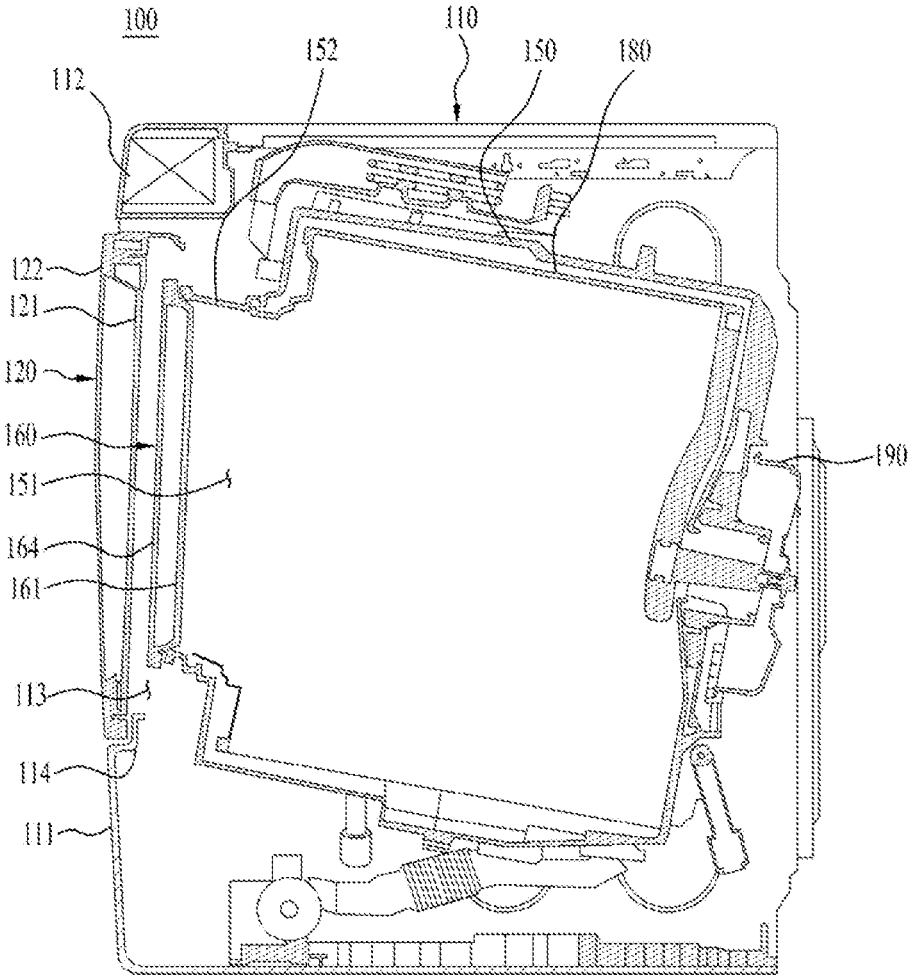
FIG. 2 is a cross-sectional view illustrating the internal structure of the washing machine according to an embodiment of the present disclosure.
Figure 3:
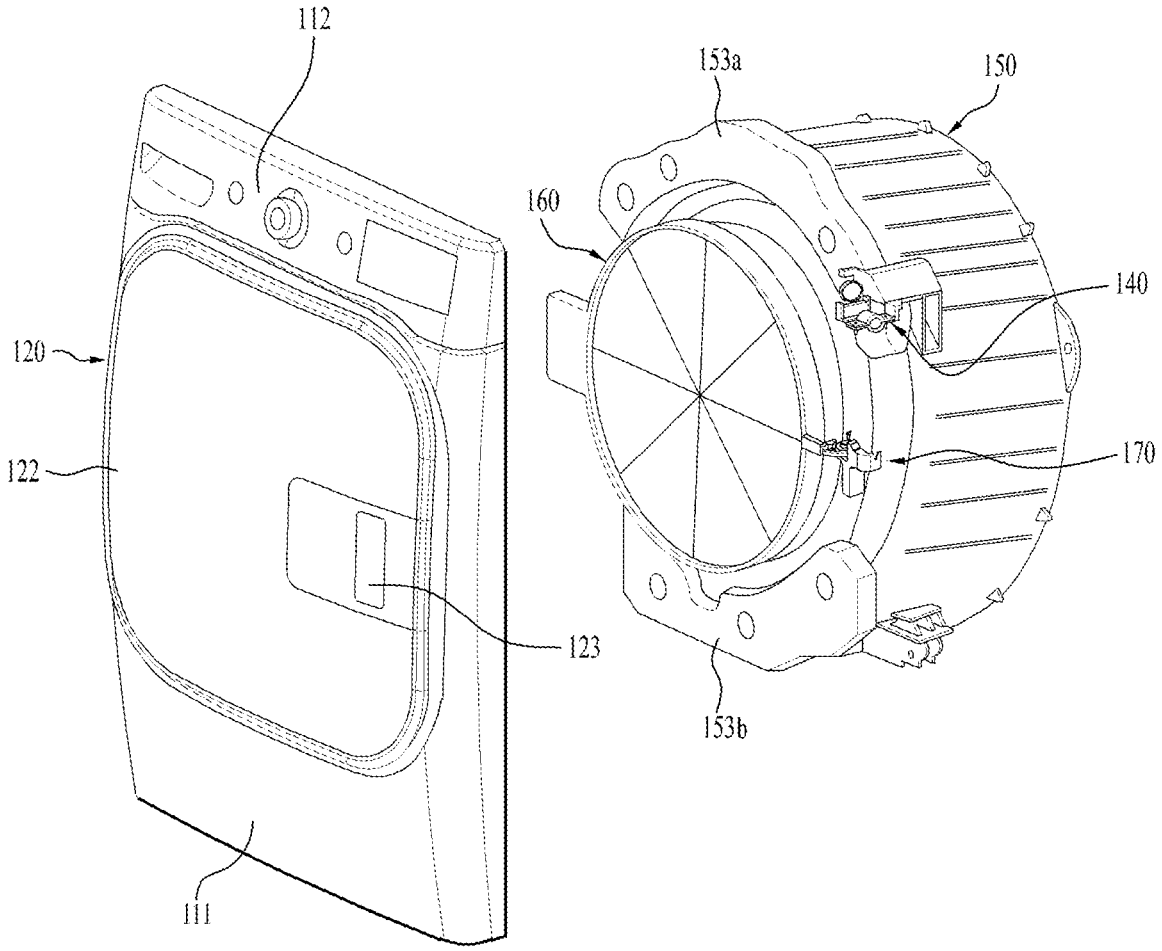
FIG. 3 is an exploded perspective view illustrating substantial components of the washing machine according to an embodiment of the present disclosure.

FIG. 1 is a perspective view illustrating the washing machine according to an embodiment of the present disclosure. FIG. 2 is a cross-sectional view illustrating the internal structure of the washing machine according to an embodiment of the present disclosure. FIG. 3 is an exploded perspective view illustrating substantial components of the washing machine according to an embodiment of the present disclosure.

As illustrated in the drawings, the washing machine 100 according to the present disclosure includes a cabinet 110 defining the appearance thereof, a tub 150 supported by a suspension such as a damper/spring in the cabinet 110 so as to store washing water, a drum 180 rotatably disposed in the tub 150 so as to contain laundry therein, and a drive unit 190 configured to rotate the drum 180.

The cabinet 110 may include a front cabinet 111 defining the front surface of the washing machine, a side cabinet 116 defining the right and left surfaces of the washing machine, and an upper cabinet 117 defining the upper surface of the washing machine.

Here, the front cabinet 111 is provided in the center thereof with a cabinet introduction port 120, through which laundry is introduced into the reception space in the drum 180, and a cabinet door 120 configured to open and close the cabinet introduction port 113. A door lock 130 (see FIG. 4) configured to set the locked state of the cabinet door is provided at one side of the cabinet introduction port 113.

The upper side of the front cabinet 111 (that is, the upper side of the cabinet introduction port 113) may be provided with a control panel 112 including a manipulation unit configured to control the overall operation of the washing machine 100 and a display unit configured to display the state of operation of the washing machine 100.

The tub 150 includes a tub introduction port 151, which is coaxially positioned with the cabinet introduction port 113 in the state of being isolated from the cabinet introduction port 113 in the cabinet 110 and through which laundry is introduced. A tub door 160 is provided at one side of the tub introduction port 151 so as to open and close the tub introduction port 151.

The present disclosure is directed to the cabinet door 120 and the tub door 160. Therefore, a detailed description of other components (for example, the drum 180, the suspension, a water supply unit, a water discharge unit, and the like) is omitted.

The cabinet door 120 is hingedly coupled to one side of the cabinet introduction port 113 so as to open the cabinet introduction port 113 in a rotating manner. The side of the cabinet door 120 that is opposite the side at which the cabinet door 120 is hingedly coupled is provided with a handle 123 configured to enable a user to open and close the cabinet door 120.

The tub 150 includes upper and lower weight balancers 153*a* and 153*b*, which are provided at upper and lower sides of the tub 150 so as to increase the mass of the tub 150 and to prevent vibration of the tub 150. A tub door 160, which is isolated from the cabinet 110 and opens and closes the tub introduction port 151 in the tub 150, is rotatably provided at one side of the tub introduction port 151 formed in the front side of the tub 150.

The tub introduction port 151 is provided with a ring-shaped rim portion 152 projecting toward the front cabinet 111. The tub door 160 is hingedly coupled to one side of the rim portion 152 so as to be rotatable, and the rim portion 152 is provided at the opposite side thereof with a tub door lock 170 (see FIG. 4) configured to set the locked state of the tub door 160.

A tub door lock releaser 140 (see FIG. 6) configured to release the locked state of the tub door lock 170 is provided between the cabinet door lock 130 and the tub door lock 170. The tub door lock releaser 140 will be described in detail when the opening and closing structure of the cabinet door 120 and the tub door 160 is described.

The tub door 160 and the tub door lock 170 are not structurally connected to the cabinet 110, and the tub 150 is structurally supported by the suspension (not shown) independently of the cabinet 110.

In other words, because only the suspension is provided but a gasket is not provided between the tub 150 and the cabinet 110, as in a conventional washing machine 100, and thus the tub 150 is completely supported only by the suspension, it is possible to remarkably reduce transmission of the vibration of the tub 150 to the cabinet 110.

Hereinafter, the opening and closing structure of the cabinet door and the tub door according to an embodiment of the present disclosure will be described in detail with reference to the accompanying drawings.

Figure 4:
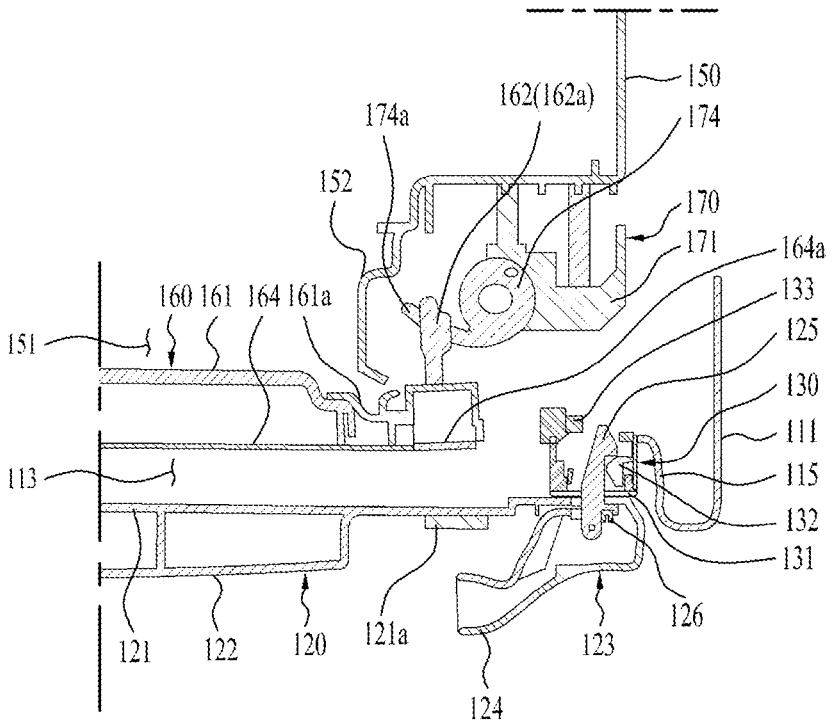
FIG. 4 is a cross-sectional view illustrating the cabinet door lock and the tub door lock according to an embodiment of the present disclosure.
Figure 5:
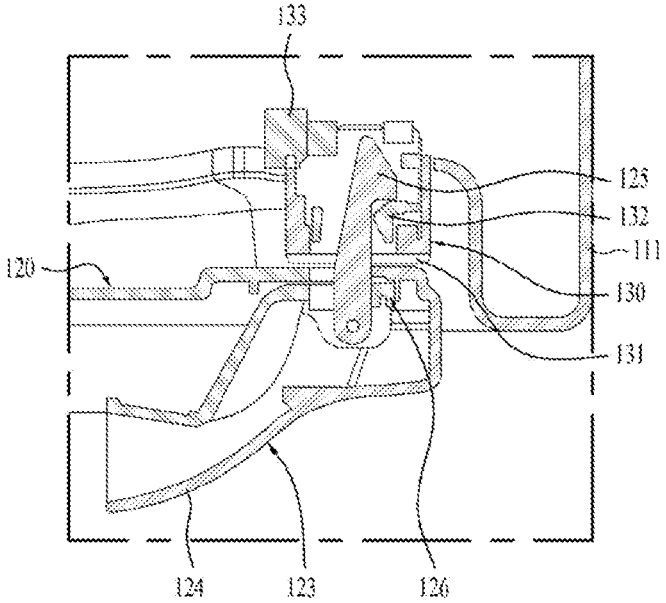
FIG. 5 is a cross-sectional view illustrating the cabinet door lock according to an embodiment of the present disclosure.
Figure 6:
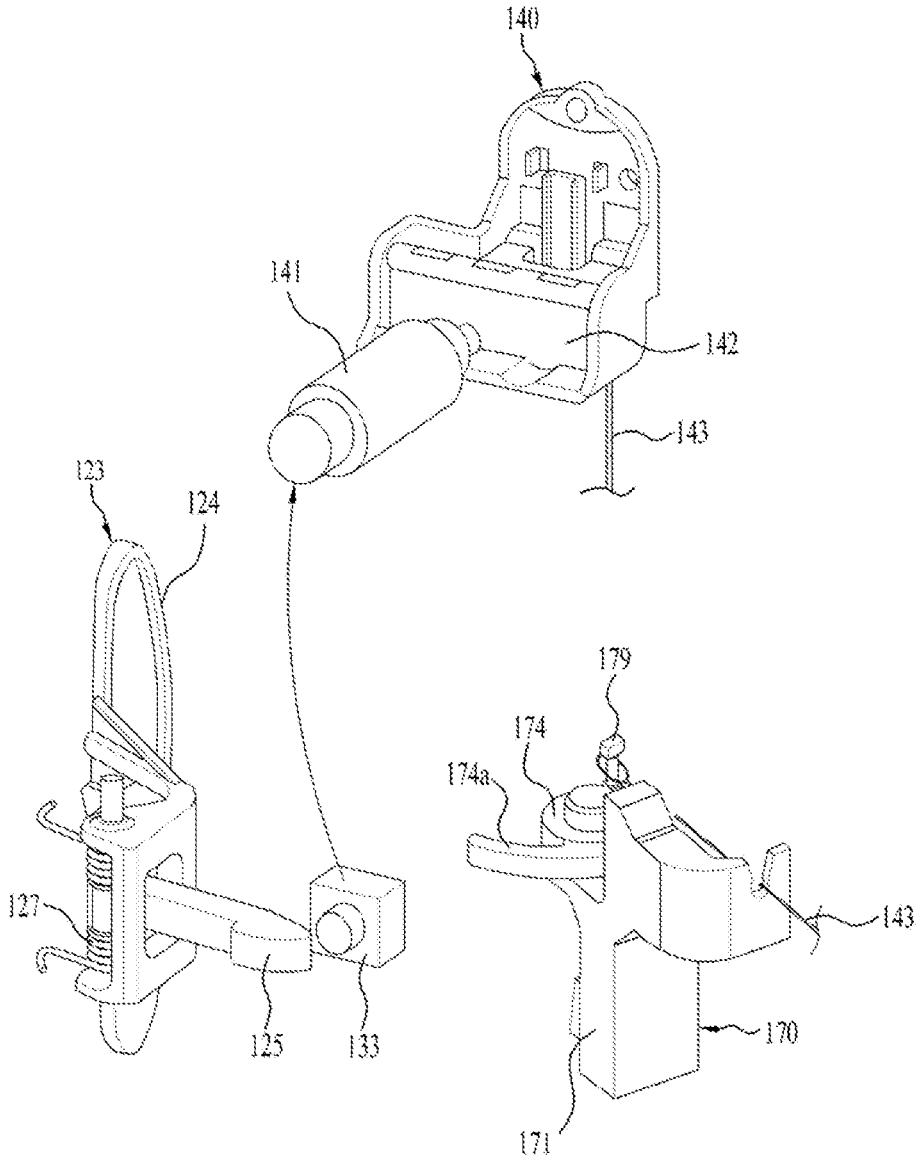
FIG. 6 is a schematic view illustrating the interlocking structure between the cabinet door lock and the tub door lock according to an embodiment of the present disclosure.

FIG. 4 is a cross-sectional view illustrating the cabinet door lock and the tub door lock according to an embodiment of the present disclosure. FIG. 5 is a cross-sectional view illustrating the cabinet door lock according to an embodiment of the present disclosure. FIG. 6 is a schematic view illustrating the interlocking structure between the cabinet door lock and the tub door lock according to an embodiment of the present disclosure.

As illustrated in the drawings, the cabinet door 120 is rotatably provided at one side of the cabinet introduction portion 113 of the front cabinet 111 so as to open and close the cabinet introduction port 113.

The cabinet door 120 includes an outer frame 122 defining the outer surface of the cabinet door 120, an inner frame 121 defining the inner surface of the cabinet door 120, and a cabinet hinge unit (not shown) configured to rotatably support the cabinet door 120 with respect to the front cabinet.

Here, the outer frame 122 and the inner frame 121 of the cabinet door 120 are coupled to each other via a fastening member (not shown) such as a bolt. The outer frame 122 and the inner frame 121 of the cabinet door 120 may each be made of a transparent material so as to enable the interior of the washing machine 100 to be checked. Alternatively, the outer frame 122 and the inner frame 121 of the cabinet door 120 may be further provided with respective transparent windows (not shown).

The outer surface of the cabinet door 120 (that is, the outer frame 122) is preferably formed as a surface extending from the front cabinet 111 so as to define the appearance of the front cabinet 111. The side of the cabinet door 120 that is opposite the hinge unit may be provided with the handle 123, configured to allow the cabinet door 120 to be opened.

The handle 123, which is formed at the outer frame 122 of the cabinet door 120, is provided at the inner side thereof with a release lever 124, which is engaged with the cabinet door lock 130 when the cabinet introduction port 113 is closed by the cabinet door 120 and which releases the locked state of the cabinet door lock 130 upon manipulation by a user.

The release lever 124 includes a hook 125, which is inserted into the cabinet door lock 130. The release lever 124 rotates and separates the hook 125 of the cabinet door 120 from the cabinet door lock 130 when a user applies force to the release lever in the direction in which the cabinet door 120 is opened.

Specifically, the release lever 124 and the hook 125 are hingedly coupled to a single rotating shaft, the hook 125 is elastically supported by an elastic spring (not shown) surrounding the rotating shaft in the direction in which the hook 125 is engaged with a hook-engaging portion 132, and the release lever 124 is elastically supported such that the hook 125 is maintained in the state of being engaged with the hook-engaging portion 132.

Here, the release lever 124 includes a hook support 126, which is provided at the hook 125 so as to transmit rotational force to the hook 125 only when the release lever 124 is rotated in the direction in which the cabinet door 120 is opened.

The inner frame 121 of the cabinet door 120 may be provided with a magnet 121*a*, which is disposed at a position corresponding to the handle 123 formed on the outer frame 122 of the cabinet door 120 so as to generate magnetic force.

Here, the magnet 121*a* is intended to generate magnetic force for application to a metal plate 164*a* of the tub door 160, which will be described later. Consequently, because the magnetic force of the magnet 121*a* is applied to the metal plate 164*a* of the tub door 160, the tub door 160 is adhered to the cabinet door 120 and is rotated together with the cabinet door 120.

The cabinet door lock 130 is provided inside a cabinet door lock mount 115 so as not be exposed to the outside of the front cabinet 110 when the cabinet door 120 is closed.

The cabinet door lock 130 includes the hook-engaging portion 132 fixed in the cabinet door lock mount 115, a hook insert 131, which is disposed outside the cabinet door lock mount 115 and is fastened to the hook-engaging portion 132 so as to be displaced in the direction in which the hook 125 of the cabinet door 120 is inserted, a spring 127 configured to elastically support the hook insert 131 in a direction opposite the direction in which the hook 125 of the cabinet door 120 is inserted, and a detector 133 configured to detect insertion and removal of the hook 125 of the cabinet door 120 when the locked state in which the hook 125 of the cabinet door 120 is engaged with the hook-engaging portion 132 is released. Here, the detector 133 generates an electric signal for operation of the tub door lock releaser 140.

The tub door 160, which is rotatably provided at one side of the tub introduction port 151 of the tub 150 so as to open and close the tub introduction port 151, may include an outer frame 164 defining the outer surface of the tub door 160, an inner frame 161 defining the inner surface of the tub door 160, and a gasket 161*a* provided on the outer circumferential surface of the inner frame 161 so as to seal the tub introduction port 151. The tub door further includes a tub hinge (not shown) configured to rotatably support the tub introduction port 151 with respect to the tub introduction port 151.

Here, the outer frame 164 and the inner frame 161 of the tub door 160 are coupled to each other by means of a fastening member such as a bolt (not shown). Furthermore, the outer frame 164 and the inner frame 161 of the tub door 160 may be made of a transparent material so as to allow the interior of the drum 180 to be viewed. Alternatively, the outer frame 164 and the inner frame 161 of the tub door 160 may further be provided with respective transparent windows (not shown).

The side of the inner frame 161 that is opposite the hinge of the tub door 160 is provided with an engaging hook 162 having an engaging hole which is engaged with the tub door lock 170. The engaging hook 162 extends a predetermined distance toward the tub door lock 170 from the inner frame 161 of the tub door 160.

The portion of the outer frame 164 of the tub door 160 corresponding to the engaging hook 162 of the inner frame 161 of the tub door 160 is provided with the metal plate 164*a* corresponding to the magnet 121*a* of the cabinet door 120.

Here, the metal plate 164*a* of the tub door 160 may be provided at a position that the magnetic force of the magnet 121*a* of the cabinet door 120 reaches when the cabinet door 120 and the tub door 160 respectively close the cabinet introduction port 113 and the tub introduction port 151.

Accordingly, when the locked state of the cabinet door 120 and the tub door 160 is released while the cabinet door 120 and the tub door 160 respectively close the cabinet introduction port 113 and the tub introduction port 151, the metal plate 164*a* of the tub door 160 may be moved and adhered to the magnet 121*a* by the magnetic force of the magnet 121*a* of the cabinet door 120.

In other words, when the locked state of the cabinet door 120 and the tub door 160 is released, the metal plate 164*a* of the tub door 160 is adhered to the magnet 121*a* of the cabinet door 120. Accordingly, the tub door 160 may be rotated toward the cabinet door 120, and then the cabinet door 120 may be rotated together with the tub door 160.

Although the magnet 121*a* has been described as being provided at the cabinet door 120 and the metal plate 164*a* has been described as being provided at the tub door 160, the magnet 121*a* may be provided at the tub door 160 and the metal plate 164*a* may be provided at the cabinet door 120.

The tub door lock releaser 140 includes a solenoid 141, which is activated when the detector 133 of the cabinet door lock 130 detects opening of the cabinet door 120, a rotating portion 142 configured to be rotated by actuation of the solenoid 141, and a tensile cable 143 configured to transmit the rotational force of the rotating portion 142 to the tub door lock 170.

The tub door lock releaser 140 is operated such that the solenoid 141 is activated so as to rotate the rotating hook of the tub door lock 170 via the tensile cable 143 connected to the rotating hook when the detector 133 of the cabinet door lock 130 detects opening or closing of the cabinet door 120.

In the embodiment, although the tub door lock releaser 140 and the tub door lock 170 have been described as being separated from each other, the solenoid 141 of the tub door lock releaser 140 may be directly provided at the tub door lock 170 such that the tub door lock 170 is interlocked with the solenoid 141 in response to the signal from the detector 133 of the cabinet door lock 130.

Hereinafter, the tub door lock will be described in detail with reference to the accompanying drawings.

Figure 7:
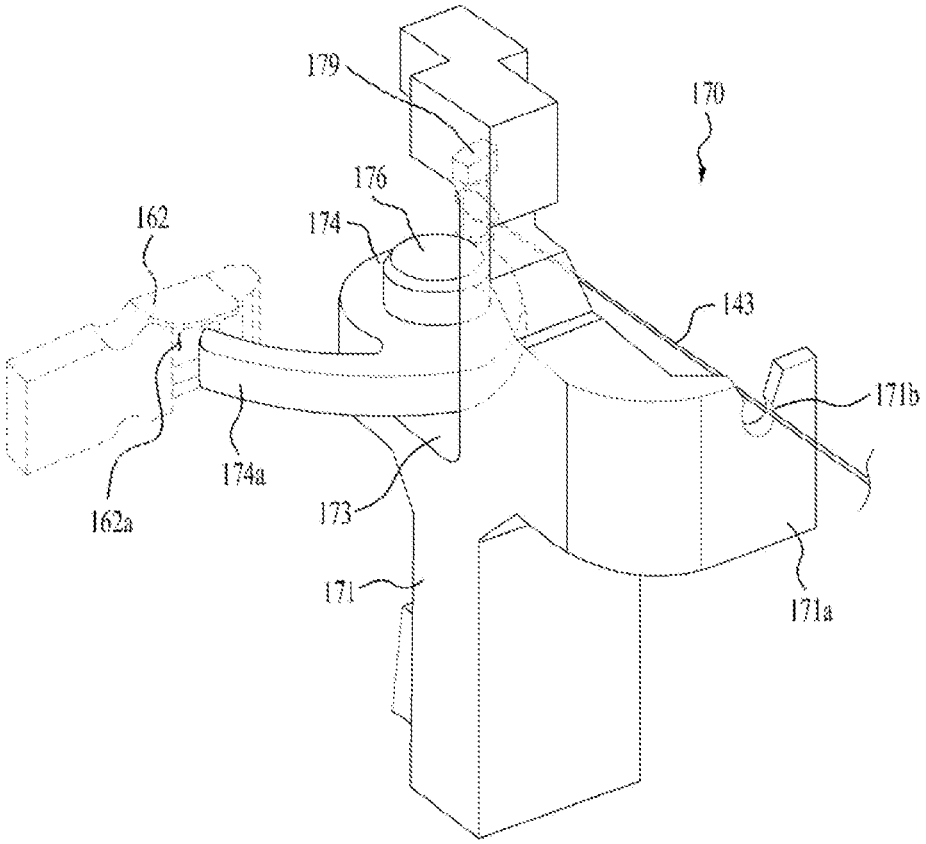
FIG. 7 is a perspective view illustrating the tub door lock according to an embodiment of the present disclosure.
Figure 8:
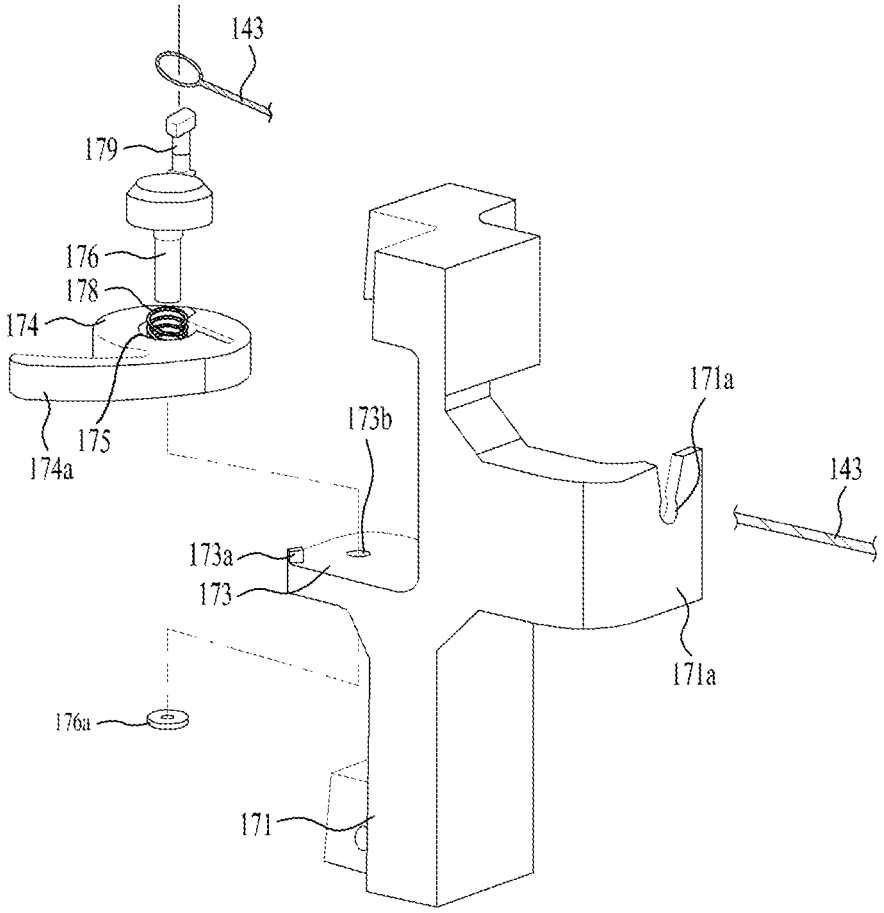
FIG. 8 is an exploded perspective view illustrating the tub door lock according to an embodiment of the present disclosure.

FIG. 7 is a perspective view illustrating the tub door lock according to an embodiment of the present disclosure. FIG. 8 is an exploded perspective view illustrating the tub door lock according to an embodiment of the present disclosure.

The tub door lock 170 is provided at one side of the tub introduction port 151 so as to set the locked state of the tub door 160 depending on whether the cabinet door 120 is open or closed.

The tub door lock 170 includes a fixed body 171 fastened to one side of the front portion of the tub 150 and a rotating hook 174 which is rotatably provided at the fixed body 171 and is engaged with an engaging hole 162*a* in the engaging hook 162 provided at the tub door 160. Here, the rotating hook 174 is connected to the tensile cable 143 provided at the tub door lock releaser 140.

The fixed body 171 is fixed to the tub 150, and includes a rotating shaft end 173 having a rotating space 172 in which the rotating hook 174 is rotatable. The rotating shaft end 173 extends toward the center of the tub introduction port 151 when the fixed body 171 is fastened to the tub 150. The rotating shaft end 173 has a holding hole 173*b* formed in the center thereof, in which the rotating hook 174 is rotatably fitted.

The upper portion of the fixed body 171 is provided with a spacing portion, which is configured to maintain a distance between the tub 150 and the fixed body 171 when the fixed body 171 is fastened to the tub 150. The side of the fixed body 171 that is opposite the rotating shaft end 173 is provided with a cable guide 171*a* configured to guide movement of the tensile cable 143. The cable guide 172*a* may have formed therein a guide groove 171*b* into which the tensile cable 143 is inserted.

The rotating shaft end 173 may be provided at one side thereof with a stop protrusion 173*a* which catches on the rotating hook 174 to prevent further rotation of the rotating hook 174 when the rotating hook 174 is rotated by the tensile cable 143.

The rotating hook 174 is rotatably fitted into the holding hole 173*b* in the rotating shaft end 173, and includes a hook protrusion 174*a*, which is provided at one side of the rotating hook 174 and is inserted into the engaging hole 162*a* in the engaging hook 162.

The hook protrusion 174*a* is curved such that the radius between the center of the rotating hook 174 and the point on the outer circumferential surface of the rotating hook 174 at which the rotating hook 174 is engaged with the engaging hole 162*a* decreases when the hook protrusion 174*a* is rotated toward the engaging hole 162*a*.

The rotating hook 174 has a rotating hole 175 formed in the center thereof, and is rotatably coupled to the rotating shaft end 173 via a rotating shaft 176, which is inserted into the holding hole 173*b* through the rotating hole 175 and is fastened thereto.

The side of the upper surface of the rotating hook 174 that is opposite the hook protrusion 174*a* is provided with a connector 179 to which the tensile cable 143 of the door lock releaser 140 is connected.

The rotating hook 174 is rotatably coupled to the rotating shaft end 173 formed at the fixed body 171 via the rotating shaft 176, and a torsion spring 178 is provided between the rotating shaft 176 and the rotating hook 174 so as to provide the rotating hook 174 with elastic force in one direction (the direction in which the locked state of the tub door 160 is released).

Consequently, the rotating hook 174 is always elastically supported by means of the torsion spring 178 in the direction in which the hook protrusion 174*a* of the rotating hook 174 is separated from the engaging hook 162 of the tub door 160. When the tub door lock releaser 140 is activated, tensile force is applied to the tensile cable 143, thereby rotating the hook protrusion 174*a* of the rotating hook 174 in the direction in which the hook protrusion 174*a* is inserted into the engaging hook 162 of the tub door 160.

Here, the hook protrusion 174*a* is curved such that the radial distance between the center of the rotating hook 174 and the point on the outer circumferential surface of the rotating hook 174, at which the rotating hook 174 is engaged with the engaging hole 162*a*, decreases when the hook protrusion 174*a* is rotated toward the engaging hole 162*a*. Consequently, when the rotating hook 174 is rotated in one direction (in which the tub door 160 is locked), the tub door 160 is fastened by the progressively stronger fastening force.

In other words, when the hook protrusion 174*a* is engaged with the engaging hook 162 of the tub door 160, the position at which the hook protrusion 174*a* is in contact with the engaging hook 162 becomes closer to the center of the rotating hook 174 when the rotating hook 174 is rotated about the center thereof.

Consequently, when the rotating hook 174 is rotated in the direction in which the hook protrusion 174*a* is inserted into the engaging hook 162, the tub door 160 is further pushed in the direction in which the tub door 160 is moved so as to close the tub introduction port 151, whereby the tub door 160 closes the tub introduction port 151 using a stronger force.

The tub door lock 170 may include an additional actuator (for example, a solenoid) configured to provide tensile force to the tensile cable in order to release the locked state of the tub door 160. The actuator may be elastically connected to the detector 133 of the cabinet door lock 130 so as to release the locked state of the tub door 160 in response to release of the locked state of the cabinet door 120 by the cabinet door lock 130.

Hereinafter, an opening and closing operation of the door of the washing machine according to an embodiment of the present disclosure will be described in detail with reference to the accompanying drawings.

First, the operation of the washing machine according to an embodiment of the present disclosure will be described in detail with reference to the accompanying drawings. The components mentioned hereinafter should be understood based on the above description and the accompanying drawings. The main characteristic of the present disclosure resides in locking/release of the cabinet door 120 and the tub door 160. Accordingly, a description of general operating procedures of the washing machine 100 (for example, a washing procedure, a rinsing procedure, a spin-drying procedure and the like) is omitted.

Figure 9:
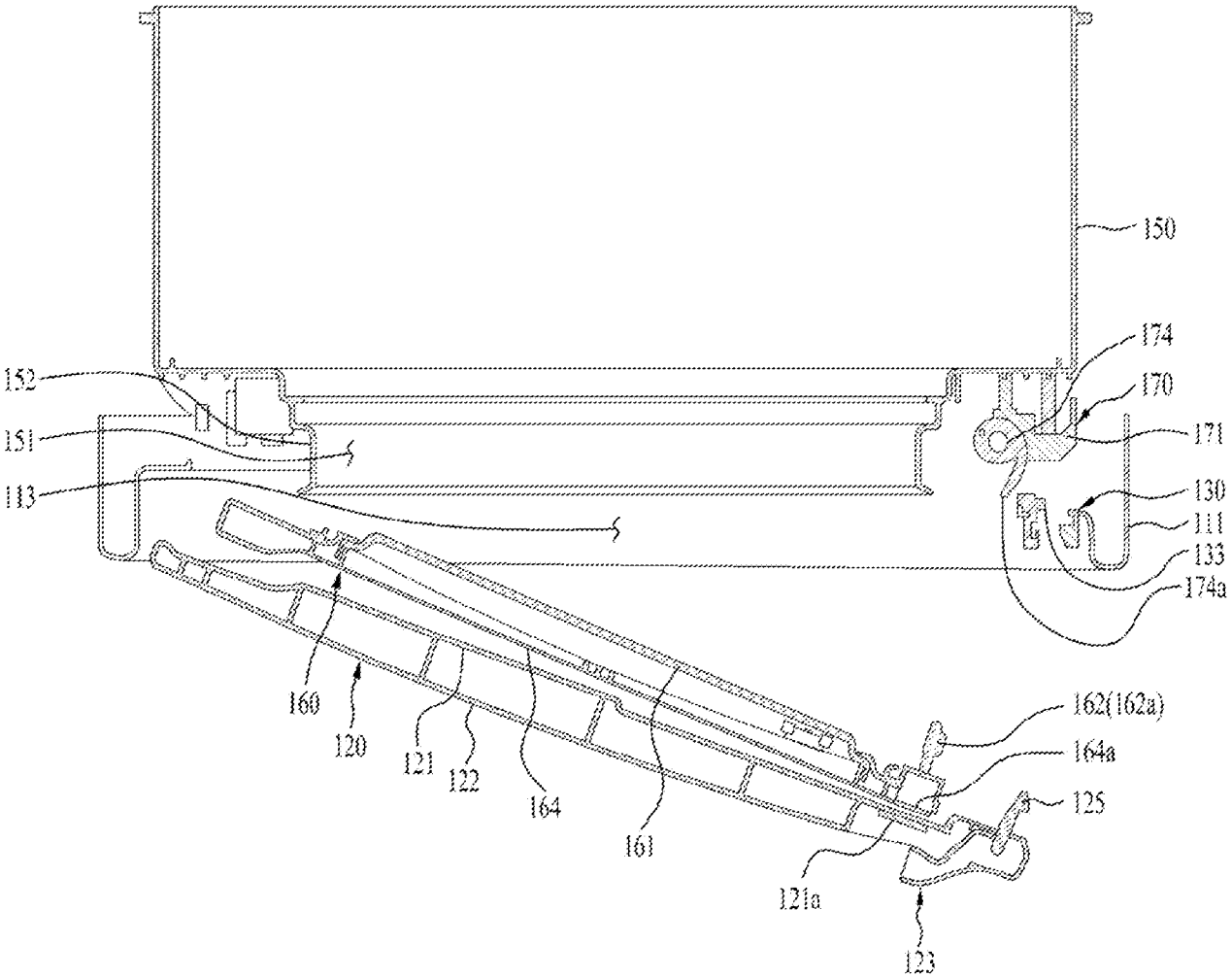
FIGS. 9 and 11 are views illustrating operation of opening and closing the door of the washing machine according to an embodiment of the present disclosure.
Figure 10:
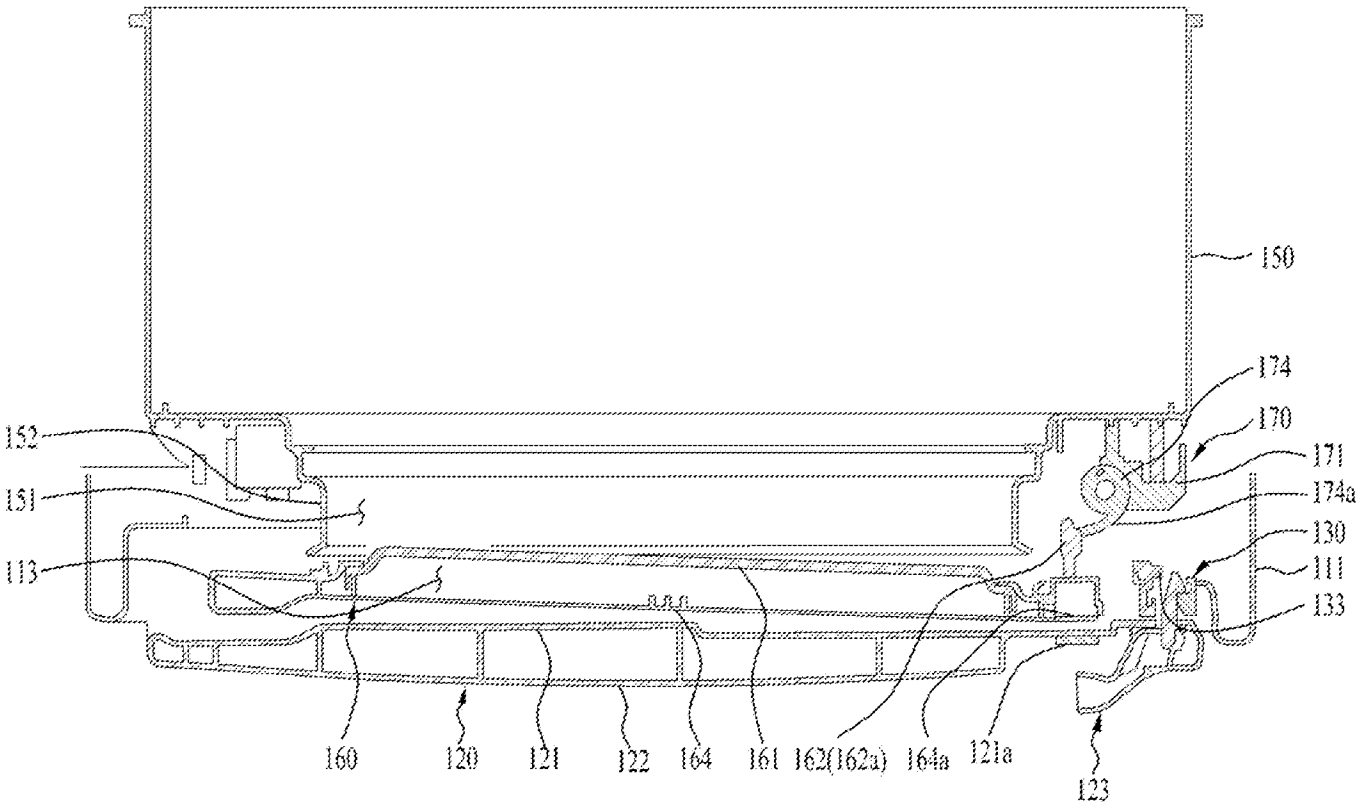
Figure 11:
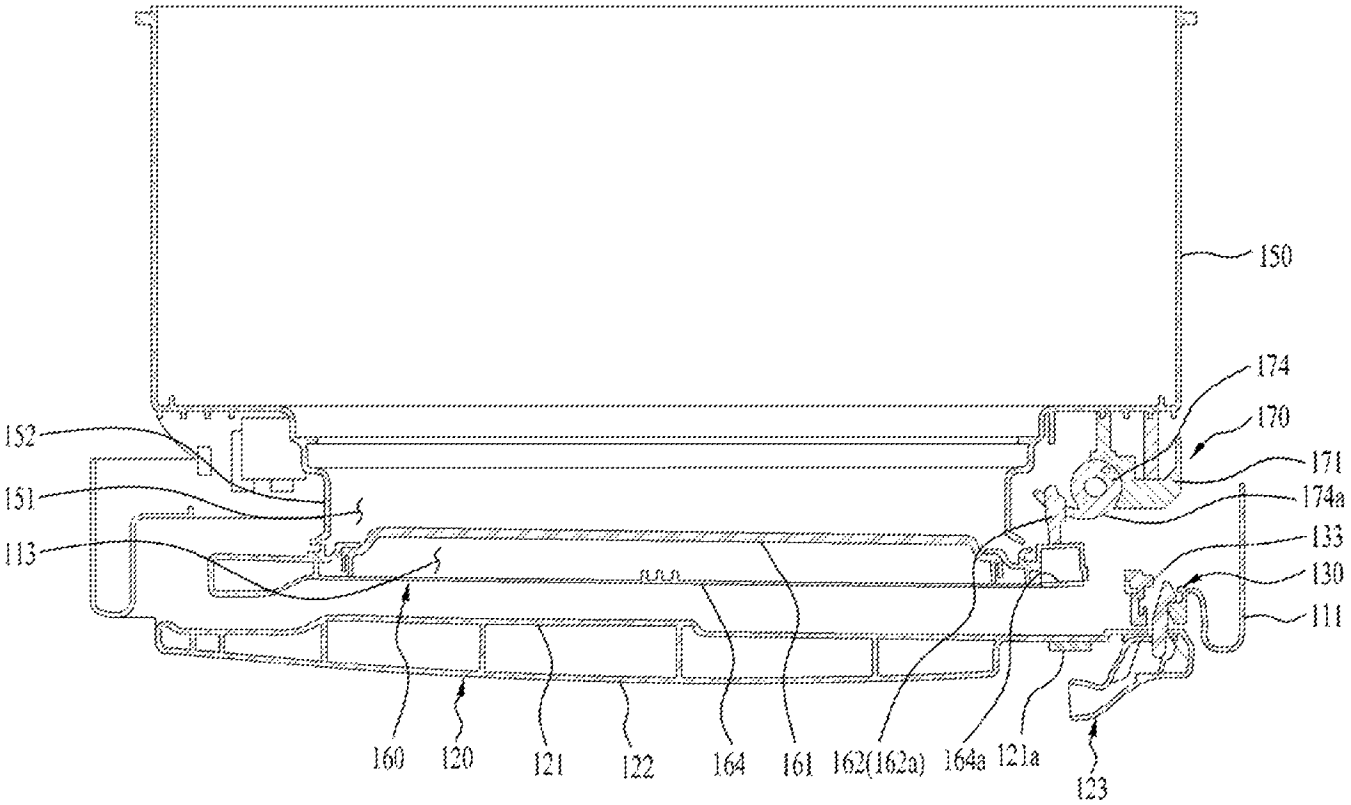

FIGS. 9 and 11 are views illustrating operation of opening and closing the door of the washing machine according to an embodiment of the present disclosure. Here, FIG. 9 illustrates the state in which both the cabinet door 120 and the tub door 160 are open. FIG. 10 illustrates the state in which the cabinet door 120 is closed while the tub door 160 is not completely closed. FIG. 11 illustrates the state in which both the cabinet door 120 and the tub door 160 are closed.

As illustrated in FIG. 9, the cabinet door 120 and the tub door 160 are rotated in the outward direction of the washing machine 100 so as to respectively open the cabinet introduction port 113 and the tub introduction port 151.

When a user rotates the cabinet door 120 to close the cabinet introduction port 113, the metal plate 164*a* provided at the outer frame 164 of the tub door 160 is adhered to the magnet 121*a* provided at the inner frame 121 of the cabinet door 120 due to the magnetic force of the magnet 121*a*.

Accordingly, the cabinet door 120 and the tub door 160 may be rotated so as to respectively close the cabinet introduction port 113 and the tub introduction port 151 in the state in which the cabinet door 120 is in close contact with the tub door 160 by virtue of the magnet 121*a* and the metal plate 164*a*.

Subsequently, as illustrated in FIGS. 10 and 11, when the cabinet door 120 and the tub door 160 are rotated, the hook 125 of the cabinet door 120 is first inserted into the cabinet door lock 130 provided at the cabinet door lock mount 115 and is engaged therewith. At this time, the tub door 160 is maintained in the state in which the metal plate 164*a* of the tub door 160 is adhered to the cabinet door 120 due to the magnetic force of the magnet 121*a* of the cabinet door 120.

When the hook 125 of the cabinet door 120 is inserted into the cabinet door lock 130, the detector 133 of the door lock 130 detects insertion of the hook 125 of the cabinet door 120. At this time, the solenoid 141 of the tub door lock releaser 140 is activated in response to detection by the detector 133, and thus the rotating portion 142 is rotated so as to apply tensile force to the tensile cable 143 due to activation of the solenoid 141.

By virtue of application of tensile force to the tensile cable 143, the rotating hook 174 of the tub door lock 170 connected to the tensile cable 143 is rotated. Therefore, the end of the hook protrusion 174*a* of the rotating hook 174 approaches the engaging hook 162 of the tub door 160, and then the hook protrusion 174*a* of the rotating hook 174 is inserted into the engaging hole 162*a* in the engaging hook 162.

Here, the hook protrusion 174*a* of the rotating hook 174 is inserted into the engaging hole 162*a* starting from the distal end thereof in the radial direction. When the rotating hook 174 is further rotated due to the actuation of the tub door lock releaser 140, the engaging hook 162 is moved in the radially inward direction of the hook protrusion 174*a* from the distal end of the hook protrusion 174*a*.

The hook protrusion 174*a* is curved such that the radius between the center of the rotating hook 174 and the point on the outer circumferential surface of the rotating hook 174, at which the rotating hook 174 is engaged with the engaging hole 162*a*, decreases when the hook protrusion 174*a* is rotated toward the engaging hole 162*a*. Consequently, when the rotating hook 174 is rotated, the tub door 160 is fastened by progressively stronger fastening force.

Meanwhile, in order for a user to open the cabinet door 120 of the washing machine 100, the user grips the handle 123 formed at the cabinet door 120 of the front cabinet 111 and then pulls the handle 123 in the direction in which the cabinet door 120 is opened.

Consequently, the release lever 124 of the handle 123, which is provided inside the handle 123, is rotated so as to release the locked state of the hook 125 of the cabinet door 120, and the detector 133 of the cabinet door lock 130 detects that the locked state of the hook 125 of the cabinet door 120 is released.

Consequently, the solenoid 141 of the tub door lock releaser 140 is deactivated in response to detection by the detector 133, thereby allowing the rotating portion 142 to be rotated to the original position. When the rotating portion 142 is rotated, the rotating hook 174 of the tub door lock 170, which is connected to the rotating portion 142 via the tensile cable 143, is rotated so as to be separated from the engaging hook 162 of the tub door 160 by the torsion spring 178, thereby releasing the locked state of the tub door 160.

When the state in which tub door 160 is locked by the door lock 170 is released, the metal plate 164*a* of the tub door 160 is attracted to the magnet 121*a* of the cabinet door 120 due to the magnetic force of the magnet 121*a*, and thus the tub door 160 is rotated toward the cabinet door 120 while in close contact with the cabinet door 120.

In other words, when a user grips and pulls the handle 123 of the cabinet door 120, the locked state of the cabinet door 120 is released, and the locked state of the tub door 160 is also released in response to the release of the locked state of the cabinet door 120. Consequently, the tub door 160, which has been released from the locked state, comes into close contact with the cabinet door 120 by means of the magnet 121*a* provided at the cabinet door 120, and is rotated together with the cabinet door 120, thereby opening the cabinet introduction port 113 and the tub introduction port 151.

In the above-described washing machine according to an embodiment of the present disclosure, since transmission of vibration and noise of the tub to the cabinet is prevented, it is possible to reduce generation of vibration and noise in the cabinet and to prevent the unpleasant vibration and noise from being transmitted to a user.

Furthermore, in the washing machine according to an embodiment of the present disclosure, since the locking/releasing structure of the cabinet door is improved, it is possible to easily open and close the cabinet door and the tub door and to open and close the tub door in response to the opening and closing of the cabinet door.

In the above-described washing machine according to an embodiment of the present disclosure, since the structure between the tub and the cabinet is improved so as to prevent vibration and noise of the tub from being transmitted to the cabinet, it is possible to reduce generation of vibration and noise in the cabinet and to prevent the unpleasant vibration and noise from being transmitted to a user.

Furthermore, in the washing machine according to the present disclosure, it is possible to increase the capacity of the due to an improvement in the structure between the tub and the cabinet.

In addition, in the washing machine according to the present disclosure, it is possible to facilitate opening and closing of the cabinet door and the tub door due to and improvement in the locking/releasing structure of the cabinet door.

Furthermore, in the washing machine according to the present disclosure, it is possible to allow the tub door to be closed in response to closing of the cabinet door.

In addition, in the washing machine according to the present disclosure, it is possible to set locking of the tub door in response to closing of the cabinet door.

Although preferred embodiments of the present disclosure have been described in detail, those skilled in the art to which the present disclosure belongs will appreciate that the present disclosure can be implemented in various modifications within the idea and scope of the present disclosure, which is defined by the accompanying claims. Accordingly, the various modifications of the present disclosure falls within the scope of the present disclosure.

What is claimed is:

1. A washing machine comprising:

a cabinet including a front surface that defines a cabinet introduction port;

a tub disposed in the cabinet, the tub having a tub introduction port coaxially positioned with the cabinet introduction port;

a cabinet door mounted on the cabinet and configured to open and close the cabinet introduction port;

a tub door mounted on the tub and configured to open and close the tub introduction port, the tub door comprising an engaging hook that has an engaging hole;

a cabinet door lock configured to set a locked state of the cabinet door and to detect whether the cabinet is open or closed; and a tub door lock configured to set a locked state of the tub door based on whether the cabinet door is open or closed, wherein the tub door lock comprises (i) a body provided at the tub and (ii) a rotating hook provided at the body and configured to rotate relative to the body, the rotating hook comprising a hook protrusion configured to insert into the engaging hole based on rotation of the rotating hook relative to the body, wherein a radius of the hook protrusion decreases toward a rotational center of the rotating hook, and wherein the hook protrusion is configured to pull the tub door toward the tub introduction port based on the hook protrusion inserting into the engaging hole.

2. The washing machine of claim 1, further comprising a tub door lock releaser configured to actuate the tub door lock based on whether the cabinet door is open or closed.

3. The washing machine of claim 2, wherein the cabinet door lock includes a detector configured to detect whether the cabinet is open or closed and to transmit a result of detection.

4. The washing machine of claim 3, wherein the tub door lock releaser includes a solenoid configured to be activated in response to a signal of the detector, a rotating portion configured to be moved in response to activation of the solenoid, and a tensile cable connected to the rotating portion.

5. The washing machine of claim 4, wherein the tub door lock and the tub door lock releaser are connected to each other via the tensile cable.

6. The washing machine of claim 4, wherein the rotating hook is elastically supported and configured to be rotated in a direction in which the locked state of the tub door is released, the rotating hook being configured to be rotated by the tensile cable in a direction in which the tub door is locked.

7. The washing machine of claim 3, wherein the cabinet door includes a hook configured to be inserted into the cabinet door lock, and the detector is configured to detect insertion and removal of the hook.

8. The washing machine of claim 7, wherein the cabinet door further comprises:

an inner frame including the hook and defining an inner surface of the cabinet door abutting the cabinet introduction port; and an outer frame that is coupled to the inner frame and that defines an outer surface of the cabinet door, the outer frame including a handle having a release lever configured to rotate the hook.

9. The washing machine of claim 8, wherein the tub door comprises:

a tub inner frame defining an inner surface of the tub door abutting the tub introduction port, the tub inner frame including the engaging hook configured to engage with the tub door lock; and a tub outer frame that is coupled to the tub inner frame and that defines an outer surface of the tub door.

10. The washing machine of claim 9, wherein one of the inner frame of the cabinet door or the tub outer frame includes a magnet configured to generate magnetic force, and the other of the inner frame of the cabinet door or the tub outer frame includes a metal plate.

11. The washing machine of claim 9, wherein the inner frame of the cabinet door includes a magnet configured to generate magnetic force, and the tub outer frame includes a metal plate.

12. The washing machine of claim 9, wherein the tub outer frame includes a magnet configured to generate magnetic force, and the inner frame of the cabinet door includes a metal plate.

13. The washing machine of claim 1, wherein the tub door comprises:

a tub inner frame defining an inner surface of the tub door facing the tub introduction port, the tub inner frame comprising the engaging hook; and a tub outer frame that is coupled to the tub inner frame and that defines an outer surface of the tub door.

* * * * *